US005601141A

United States Patent [19]

Gordon et al.

[11] Patent Number: 5,601,141

[45] Date of Patent: Feb. 11, 1997

[54] HIGH THROUGHPUT THERMAL CYCLER

[75] Inventors: Steven J. Gordon, Jamaica Plain; Anthony J. Christopher, Andover, both of Mass.

[73] Assignee: Intelligent Automation Systems, Inc., Cambridge, Mass.

[21] Appl. No.: 959,775

[22] Filed: Oct. 13, 1992

[51] Int. Cl.[6] ..... F25B 29/00

[52] U.S. Cl. ..... 165/263; 422/67; 422/109; 422/116; 165/64; 165/168; 435/285.1; 435/286.1; 435/288.4; 935/87; 935/88

[58] Field of Search ..... 435/289, 290, 435/285.1, 286.1, 288.4; 165/30, 64, 168; 422/67, 109, 116; 935/87, 88

[56] References Cited

U.S. PATENT DOCUMENTS

| | | | |
|---|---|---|---|
| 3,143,167 | 8/1964 | Vieth | 165/30 |
| 3,360,032 | 12/1967 | Sherwood | 165/30 |
| 3,869,912 | 3/1975 | Horvath | 165/168 |
| 4,544,259 | 10/1985 | Tezuka et al. | 165/30 |
| 4,858,155 | 8/1989 | Okawa et al. | 422/63 |
| 4,865,986 | 9/1989 | Coy et al. | 435/290 |
| 4,950,608 | 8/1990 | Kishimoto | 435/290 |
| 5,061,630 | 10/1991 | Knopf et al. | 435/290 |
| 5,123,477 | 6/1992 | Tyler | 435/290 |
| 5,142,969 | 9/1992 | Chun | 435/289 |
| 5,158,132 | 10/1992 | Guillemot | 165/30 |
| 5,161,609 | 11/1992 | Dutretre et al. | 165/61 |
| 5,176,202 | 1/1993 | Richard | 165/48.1 |
| 5,187,084 | 2/1993 | Hallsby | 435/290 |
| 5,302,347 | 4/1994 | Van Den Berg et al. | 422/67 |
| 5,435,378 | 7/1995 | Heine et al. | 165/168 |

FOREIGN PATENT DOCUMENTS

| | | | |
|---|---|---|---|
| 61-149079 | 7/1986 | Japan | 435/290 |
| WO89-09437 | 10/1989 | WIPO . | |

OTHER PUBLICATIONS

Product Bulletin, "Temp. Tronic Thermal Cycler Dri Bath". (No date).

Advertisement, Perkin Elmer "DNA Thermal Cycler 480 System". (No date).

Advertisement, M. J. Research. Inc., "The MiniCycler™". (No date).

*Primary Examiner*—John K, Ford

*Attorney, Agent, or Firm*—Peter J. Manus, Esq.

[57] ABSTRACT

A batch thermal cycler for large numbers of biological or chemical samples uses n modules each in good thermal contact with the samples, but substantially isolated from one another, thermally and functionally. Each module carries samples on an upper sample plate. The module has a temperature sensor adjacent the samples, an electrical resistance heating element, and a circulating fluid heat exchanger for step cooling. Heating occurs at a point generally between the samples and the source of the cooling. The modules are individually replaceable. O-rings automatically seal fluid and electrical interfaces. An electrical controller has n simultaneous channels that provide closed loop control of the electrical power to each module. As a method, the invention includes at least one modular temperature zone where the temperature is sensed at a point adjacent the samples in that zone. The samples are heated adjacent the sample plate. Cooling is by a step change. The cooling overshoots a set lower temperature. A small, well-controlled heating corrects the overshoot.

13 Claims, 4 Drawing Sheets

HIGH THROUGHPUT THERMAL CYCLER

BACKGROUND OF THE INVENTION

The invention relates in general to batch biological and chemical and analysis of large numbers of samples. More specifically it relates to a fast response thermal cycler that carries a large batch of samples through one or more predetermined temperature profiles.

In biological and chemical testing and experiments it is often necessary to repeatedly cycle samples of a biological specimen or chemical solution through a series of different temperatures where they are maintained at different set temperatures for predetermined periods of time. While single sample processing can be used, many experiments, particularly ones in modern biological experimentation, require the use of large numbers of samples. Modern biological testing often uses micro-titration plates. A standard such plate is a plastic sheet with 96 depressions, each adapted to hold one of the samples to be processed. The plastic is sufficiently thin that the sample can readily reach a thermal equilibrium with a conductive mass at the opposite face of the plastic sheet. Testing also often requires a large number of cycles in each experiment, e.g. fifty. For cost effective processing it is therefore important to reach and stabilize at a set temperature rapidly. It is also cost effective, and sometimes necessary, to process a large number of samples in each experimental run. A plate of 96 samples is more cost effective than the processing of samples one by one.

Various devices and techniques are known for the thermal cycling of multiple samples. The most common technique utilizes thermoelectric devices. The apparatus sold by M. J. Research Inc. under the trade designation "Minicycler" is typical. It uses all solid state electronics and the Peltier effect. Conventional refrigeration techniques are also known, as is the combination of electrical heating and water cooling, as used in a device sold by Stratagene Inc. under the trade designation Temperature Cycler SCS-96.

These devices operate reasonably well, but they operate on only one plate. One problem with somehow expanding these devices to handle multiple plates is that a uniform temperature profile for a large number of plates requires multiple temperature sensing devices at various locations and a way to vary the temperature quickly and reliable at any portion of the samples. Another problem is that any malfunction or diminution of function of any component requires a repair of a complex system that extends over this large area. Repairs can disable the entire unit, and they can be slow and expensive. A further problem is that known cyclers, regardless of claims to be able to move to a new temperature rapidly, are nevertheless comparatively slow, regardless of the number of plates being processed. For example, a typical thermoelectric unit takes 210 to 230 seconds to go from room temperature to 94° C. and stabilize there. If an experiment requires 50 different temperature cycles of this magnitude, then 3 to 4 hours is used just in cycling to new temperatures. This is a significant source of delay in conducting the experiment, and a significant element of cost.

It is therefore the principal object of the invention to provide a thermal cycler and a method of operation with a high sample volume, good temperature control, and fast response time to yield a high throughput that is multiple times greater than throughputs attainable heretofore.

Another object of this invention is to provide a foregoing advantages while also providing extreme ease of maintenance of the cycler.

A further object is to provide a cycler which is highly flexible and can be adapted to process a variety of sample holders, or to receive the samples directly.

Still another object is that it provides the foregoing advantages while also allowing the simultaneous running of different temperature profiles.

SUMMARY OF THE INVENTION

A high throughput thermal cycler has a base and an array of modules mounted on a base. The base is insulating and is preferably a thick sheet of a high temperature plastic. The modules each connect in a fluid tight seal to the base and through openings in the base to one of a set of manifolds that distribute a cooling fluid such as water. The base also mounts a like set of conduits that enclose and seal conductors that carry electrical power to the modules. A controller, preferably one with n simultaneous closed loop channels each associated with one of n modules, regulates the electrical current and cooling fluid flows to each module in response to a signal from a temperature sensing element associated with each module.

The modules are preferably formed in three layers—a sample plate, a heater plate, and a cooling plate adjacent to a manifold. In the preferred form, the module also includes a temperature sensor located in the heater plate adjacent the sample plate. The sample plate is preferably replacably secured at the upper surface of the module on the heating plate. The sample plate is adapted to receive a standard micro-titration plate, or other labware, in a close, heat-transmitting engagement. The heater plate and cooling plate may be formed integrally, but as described herein they are separate plates secured in a stack. An electrical resistance heater embedded in the heater plate is adjacent the sample plate. It extends through the module horizontally to produce a generally uniform thermal profile across the sample plate. Its proximity to the sample plate, in combination with forming the module of a material that has a good heat conductivity characteristics, such as aluminum, provides a fast response mechanism for heating the samples. The heating element has its free ends projecting from the lower face of the module. They pass through aligned holes in the base to connect to the power conductors in the conduits. O-rings seal these pass-throughs.

The cooling plate constitutes the lower portion of the module. It includes a fluid carrying passage. In the preferred form this passage is open to the upper face of the plate and is closed by the lower face of the heating plate. O-rings seal this inter-plate interface. When the module is secured onto the base, o-rings carried in grooves on the upper surface of the base seal inlet and outlet through the module and base. These inlet and outlet holes provide fluid communication between the associated module and fluid carried in the associated manifold.

Viewed as a method, the invention includes cycling the samples in groups (organized as a single module or zone or as groups of modules or zones) substantially independently of one another. It also includes heating the samples at a point adjacent to them, sensing the sample temperature adjacent to the samples, and cooling in a step change, with an overshoot past a desired lowered temperature, followed by a controlled heating back up to the desired lower temperature. The temperature overshoot is sensed within the modules, but the sample temperature lags the sensed temperature somewhat due to the thermal inertia of the plates. The samples themselves do not reach a temperature below the lower set temperature.

These and other objects and features of the invention will be more readily understood from the following detailed description of the preferred embodiments of the invention which should be read in light of the accompanying drawings.

DETAILED DESCRIPTION OF THE PREFERRED EMBODIMENTS

Figure 1:
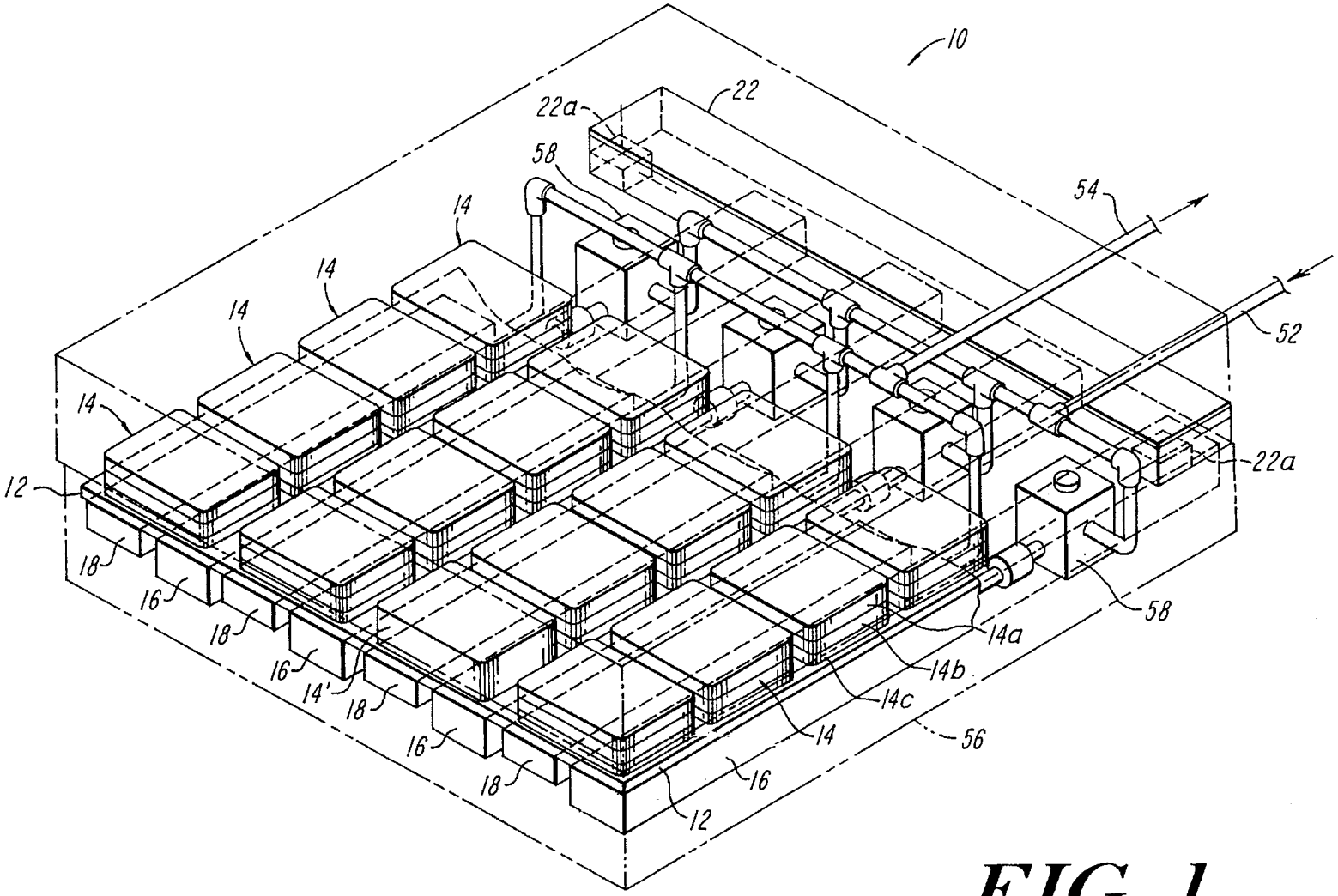
FIG. 1 is a view in perspective of a high throughput thermal cycler according to the present invention.
Figure 2:
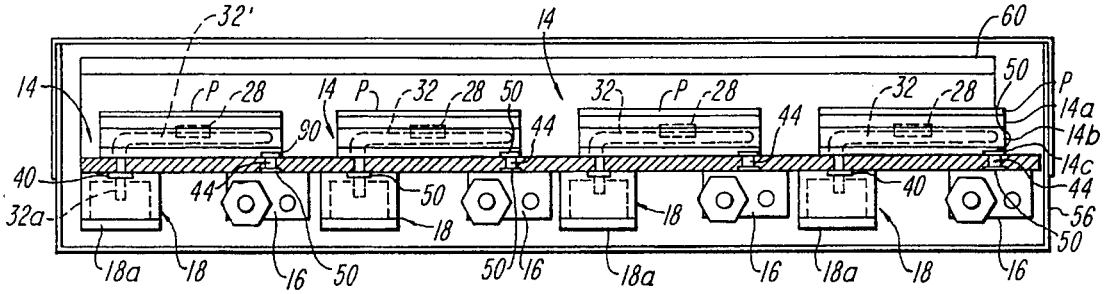
FIG. 2 is a view in front elevation with the front panel removed, of the thermal cycler show in FIG. 1.
Figure 3:
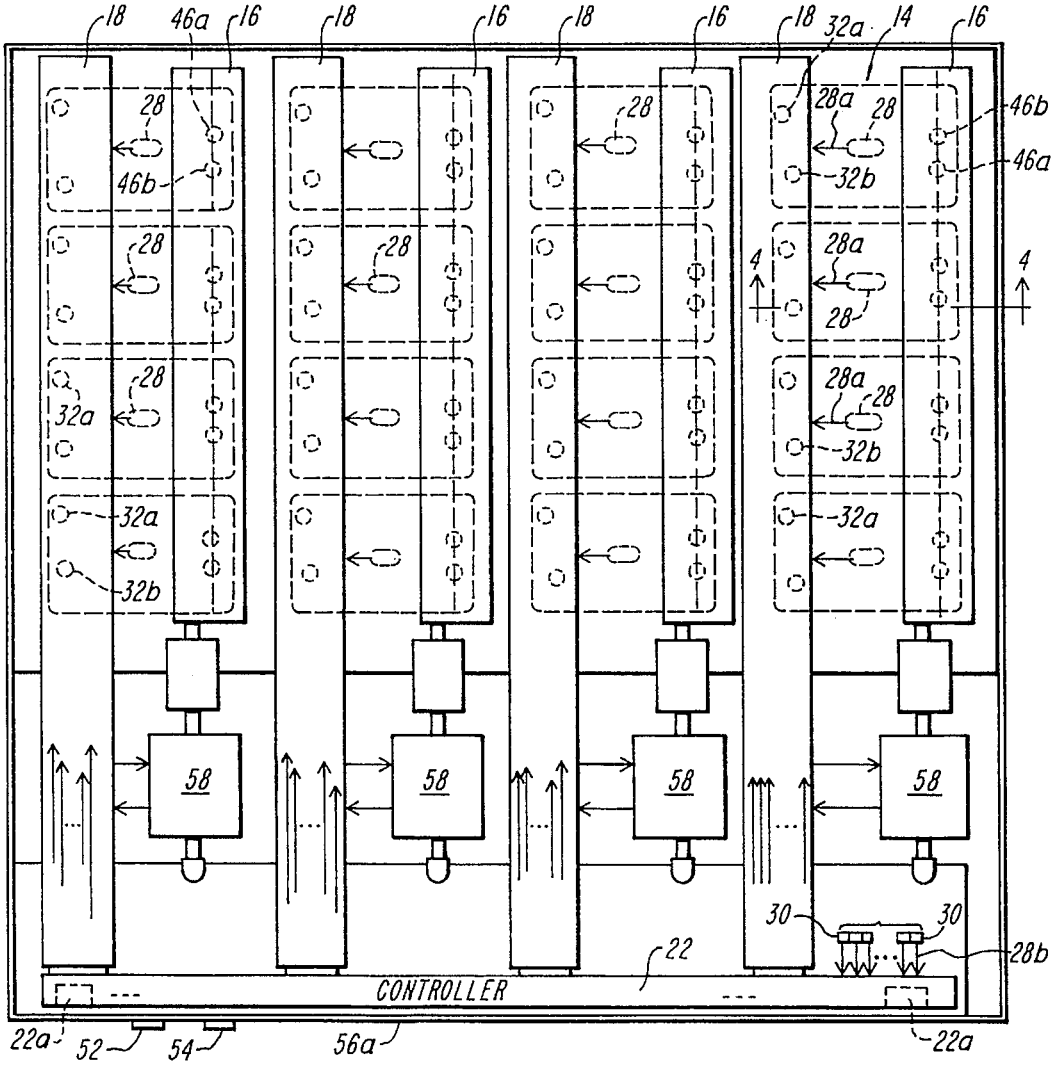
FIG. 3 is a bottom plan view of the thermal cycler shown in FIGS. 1 and 2.
Figure 4:
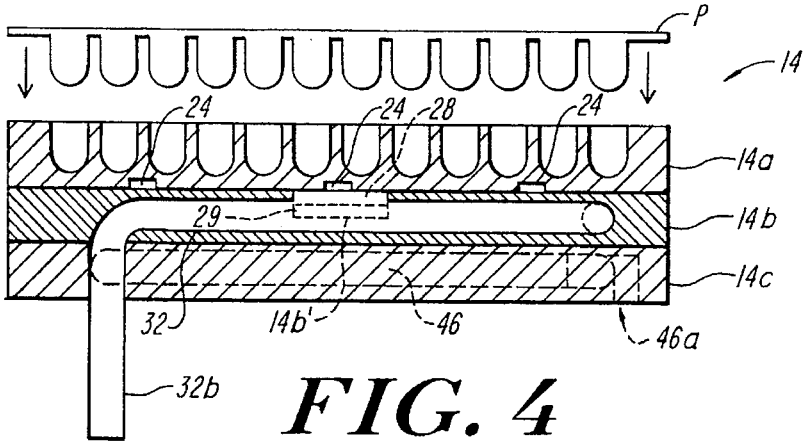
FIG. 4 is a view in vertical section taken along the line 4—4 of one of the modules shown in FIGS. 1 and 2 with a standard micro-titration plate positioned over it.
Figure 6:
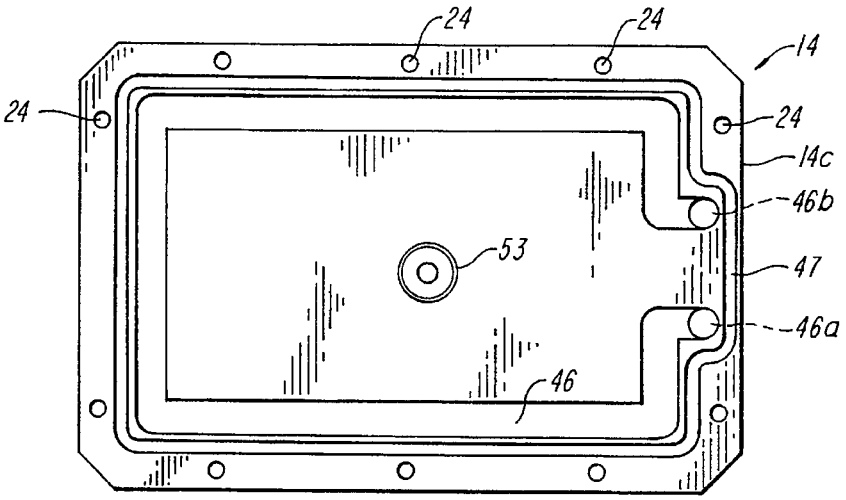
FIG. 6 is a top plan view of the module shown in FIGS. 4 and 5 with both the sample and heater plates removed.
Figure 5:
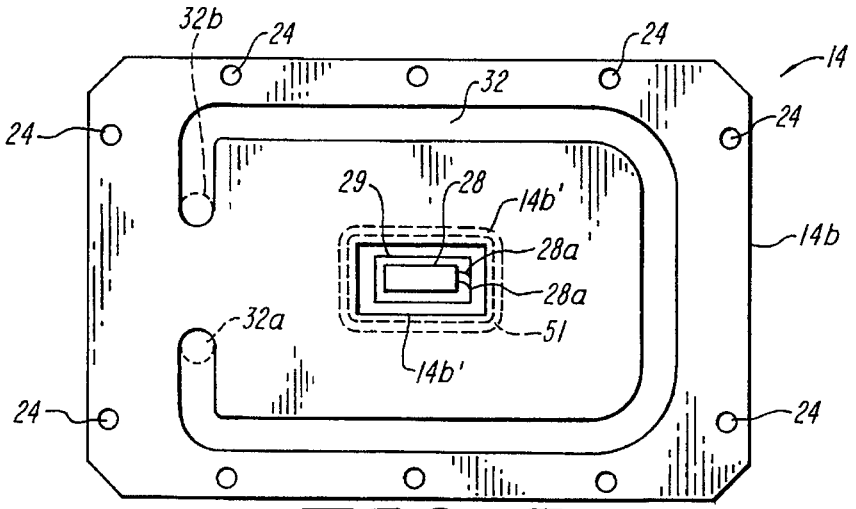
FIG. 5 is a top plan view of the module shown in FIG. 4 with the sample plate removed.

FIGS. 1–3 show a high throughput thermal cycler 10 of the present invention. As shown, the cycler 10 is adapted to heat and cool sixteen standard micro-titration plates P simultaneously, although the precise number of plates P being processed is not limited to sixteen. The cycler is particularly adapted to process biological samples for an experiment requiring a large number of samples (e.g. 16×96) to be carried through a large number of thermal cycles (e.g. 50). A base 12 supports an array of sixteen modules 14 that in turn each carry one of the plates P. The base is preferably flat, thick sheet of an insulating material such as a high temperature plastic. The modules 14 are preferably arrayed in four rows of four modules each, as shown. The modules are spaced laterally, from one another which in combination with forming the base of the insulator, provides a good degree of thermal isolation of each module.

A manifold 16 mounted under the base extends along each row of four modules 14 at one end of each module. A solenoid valve 58 associated with each manifold controls a flow of cooling water, or other fluid, into the manifold for distribution to the four associated modules. The cooling of these four modules is therefore not totally independent for each module. But this array does allow the simultaneous running of four different temperature profiles, each profile being run in the four modules associated with the same manifold 16.

A conduit 18 also extends along each row of modules in parallel with an associated one of the manifolds 16, but lying under the opposite end of the modules from the associated manifold. The conduit has a rectilinear cross section, is formed of any suitable structural material, and is sealed to the base in a water tight relationship to protect the electrical conductors inside from a short circuit due to an inflow of water. The conduit preferably has a cover 18*a* that is replacably sealed to allow access to the interior of the conduit. The electrical conductors carry electrical power to the modules. A controller 22 controls the current flowing to the modules. The controller has n channels for the n modules.

The modules 14 each include a sample plate 14*a*, a heating plate 14*b*, and a cooling plate 14*c*. These plates can be actual separate plates sandwiched together, or they can be formed integrally. In the presently preferred form they are separate plates. Also, in the presently preferred form each module includes a temperature sensor 28 carried in the heater plate 14*b*. Screws 24 replacably secure the plates in a stack. The cooling plate 14*c* is at the bottom of the modules, adjacent to the base 12. The Screws 24 can also secure the module 14 as a whole to the base by extending into threaded holes on the base, or other screws can be used which extend through the module or upwardly through the base to threaded holes in the bottom of the module. The module 14 is formed of the material that exhibits good heat conductivity, such as aluminum. Removing the screws 24 allows the plate 14*a* to be changed easily to accommodate different sample holders adapted to different labware, or to hold samples directly on the plate 14*a*. As shown, the plate 14*a* is comparatively thin in the vertical direction (typically 0.5 inch) and has ninety six depressions 14*a*' in array that mates with the standard microtitration plate P. Because the plate P is a thin plastic sheet and sample plate 14*a* is highly conductive, there is good heat transfer between the samples held in the plate (or directly in a depression 14*a*') and the plate 14*a* itself when the plates are in a close physical contact. In practice the sample temperature equilibriates with the plate 14*a* quickly, with the precise period depending on factors that include the sample volume.

The heating plate 14*b* has an upper surface that is in substantially continuous contact with the sample plate 14*a* to promote a good thermal conduction there between, except for a shallow cavity 14*b*' generally centered in the module. The thermocouple 28 rests in the cavity 14*b*'. It has with a generally flat sensing surface positioned against the bottom of the sample plate 14*a*. Preferably a piece of resilient material 29 located under the thermocouple 28 urges it into a good physical contact with the bottom of the holder plate 14*a*. This geometry and resilient spring force provides an accurate reading of the temperature of the plate 14*a*, and hence of the sample held on the plate. Wires 28*a* carry an electrical output signal from the thermocouple 28, through the module 14 and the base 12, to a connector 30. Wires 28*b* then conduct the signal from the connector 30 to the controller 22. The connector 30 facilitates a plug-in connection of the temperature sensor associated with each module to the central controller 22. The thermocouple is preferably a model CO1-T sold by Omega Engineering of Stamford, Conn. The connector 30 can be any conventional thermocouple connector for thermocouple signal wires.

A heating element 32 is embedded in plate 14*b*. The heating element can be any of the wide variety of electrical resistance heaters, but the formed tubular heater sold by Rama Corporation of San Jancinto, Calif. is preferred. It is formed into a suitable loop to distribute the heat generally uniformly across the module. The element is shown schematically as a c-shaped loop, but it will understood that many other configurations can be used as long as the heating is generally even across the module. The heating element can be press fit into a groove machined into the upper or lower faces of the plate 14*b*. Its free ends or "legs" 32*a* and 32*b* are angled to pass through the module vertically and project from the module downwardly through suitably aligned openings in the base 12. They are connected manually to the conductors in the conduits, e.g. by conventional screw clamp connectors. O-rings 40 held in a groove machined on the conduit 18 seal the heating element 32 around its legs 32*a* and 32*b* at the point where the point of entry.

The cooling plate 14*c* has a groove 46 formed in its upper face which together with the opposed bottom surface of the heater plate 14*b* forms a passage for the flow of a cooling fluid, preferably water. The groove 46 is dimensioned and configured to provide a rapid decrease in the temperature of the plate 14*c* in response to a flow through the passage of cooled water from an inlet 46*a* to an outlet 46*b*. The inlet 46*a* and outlet 46*b* are preferably cylindrical holes drilled vertically in the module cooling plate and aligned holes 44 drilled through the base. This flow, typically 0.15 gal/min of water per module at about 20° C., quickly reduces the temperature of the cooling plate by convection. Portions of the cooling plate that lie below the passages, as well as the plates 14*a* and 14*b*, are cooled rapidly by conduction, but slightly less rapidly then the portions of the plate 14*c* laterally adjacent to the passage which have a shorter thermal path to the water flow then the plates 14*a* or 14*b*. An O-ring 47 seated in a groove machined in the upper face of the cooling plate 14*c* encircles the cooling passage. It projects slightly above the surface of the plate 14*c* when the module is not secured to the heater plate. Assembling the module plates to one another compresses the O-ring 47 between the cooling and heater plates to guarantee a water tight seal. O-rings 50 encircle each interface between the base 12 and (i) the module 14 at its upper surface and (ii) manifold 16 at its lower surface. In the preferred form shown, they encircle the cylindrical holes 44 drilled through the base to provide fluid communication to and from the module. The O-ring 50 are seated in grooves machined in the module and the manifold. The grooves are dimensioned so that the O-rings are compressed into a reliable water tight seal when the module and manifold are secured to the base. An O-ring 51 encircles the cavity 14*b*' to seal it and the thermocouple 28 held in it against the water.

Each manifold has internal conduits or dividing walls (shown schematically in phantom in FIG. 2) which separate the pre-cooled water from used, warm water. The cool water flows to inlets 46*a* and the used water flows from module outlets 46*b*. These flows in all the manifolds originate at a main cooled water inlet 52 and exit at a main used water outlet 54. As shown, the inlet 52 and outlet 54 are mounted in a side wall 56*a* of a housing 56. They provide a convenient point of connection for the cycler to an external source of cold water and a drain, or other collection point, such as a reservoir that feeds a closed loop refrigeration system for the water. The four electrically operated solenoid valves 58, each mounted in a fluid conduit feeding one of the manifolds 16, control the flow of cooling water to an associated manifold. The valves provide an on-off control.

The controller 22 produces electrical control signals for the valves 58 and for the electrical power supply to each of the heating elements 32. A controller operates in response to the sensed temperature of the thermocouples 28 as relayed over the wires 28*a*, 28*b* via connectors 30. The controller 22 is a PC compatible unit of conventional design. It includes a 16 channel analog-to-digital convertor that transforms the analog temperature signal from the thermocouples into corresponding digital signals. Sixteen single bit output signals drive a like number of solid state relays to switch electrical power supplied to the heaters 32 between on and off states. The amount of electrical power being supplied at any given time is regulated by pulse width modulation of the switching. The controller employs sixteen simultaneous closed loop control systems run in software. The closed loop control systems are of the proportional plus integral plus derivative (p.i.d.) type. The controller also produces an output control signal that opens and closes the valves 58 to produce a step-like decrease in the temperature.

In operation, to heat a module 14 upwardly to a set temperature $T_1$, the controller produces an output signal that supplies electrical energy to the associated heating element 32 at a rate that carries it rapidly to the set temperature, but approaches without an overshoot. The thermal characteristics of the module and the sensitive, fast response of the electronic controls provide a critically damped and accurate heating loop with a fast response. The module characteristics which promote this response include the close proximity of the heating elements and thermocouples to the sample plate. Heat produced by the heating elements 32 is conducted to the plates 14*a* and P and to the samples in a few seconds, typically less than a minute. The heat reaches the thermocouple roughly the same time as it reaches the samples.

Figure 7:
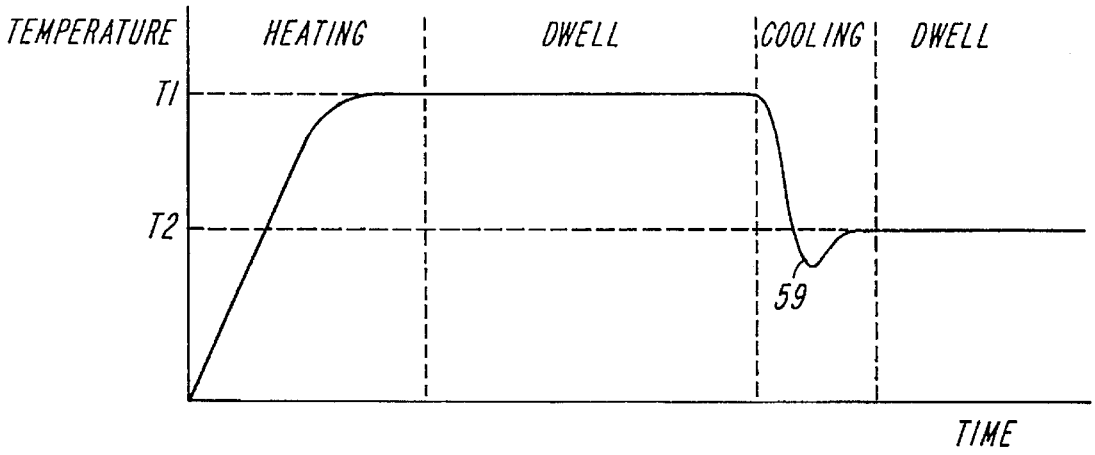
FIG. 7 is a graph of the temperature response of the thermal cycler shown in FIGS. 1–3 and the module shown in FIGS. 4–6 as it cycles to a higher temperature $T_1$ and then a lower temperature $T_2$.

To cool a module 14, the associated valve 58 is opened to introduce a flow of cooling water to the passage 46. The flow causes a sudden, step-like decrease in the temperature as shown in FIG. 7. The duration of the flow is calculated to lower the temperature toward a lower set temperature $T_2$, but with a small overshoot 59 (FIG. 7). To reach precisely the set lower temperature, the heating element activates to increase the temperature back up to the lower set temperature $T_2$. The fluid cooling is thus not precisely closed loop controlled. The on-off cooling fluid flow it is simpler, faster and better than a closed loop control for maintaining a long life for the solenoid valves 58. The heating elements 32 provide a faster response because there is no large thermal inertia to overcome—as with water—and because the thermocouple 28 is in close proximity to the samples. This heating and its closed loop control provide a precise, fine tuning over the sample temperature. Note when the modules are cooled, the sensed temperature within the module overshoots the lower set temperature $T_2$, but the sample itself does not fall below $T_2$.

To maintain any set temperature during a dwell period, the present invention balances small inputs of heat from the heating element against ambient cooling.

If there is a malfunction in a module the screws 26 are removed allowing the module to be replaced with a simple pulling movement away from the base 12. The legs 32*a* and 32*b* of the heating elements can disconnected from the conductor—or from a receptacle mounted in the conduit 18. However, in the presently preferred form they are manually disconnected from power lines carried in the conduit by releasing screw clamping connectors. The movement of the manifold away from the base automatically breaks the fluid connection path between the module passages 46 and the holes 44 in the base leading into the manifold 16. The thermocouple electrical connection to the controller is broken manually at the connector 30. A new module is connected into the cycler in a few minutes by reversing this disassembly process.

The modularity of the present invention thus facilitates repair of the cycler as well as providing the ability to simultaneously cycle multiple standard plates. It is also significant to note that four modules associated with each manifold can be separately operated on a different temperature profile than modules connected to other manifolds. A cycler 10 can process samples simultaneously using as many different temperature profiles as there are manifolds. With standard single plate cyclers, one would have to purchase and operate simultaneously sixteen separate cyclers to obtain a comparable sample volume.

In the preferred forms the cycler 10 has an insulated cover 60 that encloses the samples to assist in stablilizing their temperature and to press sample-holding the plates P firmly against the sample plates 14*a*. The cover can be moved manually, or it can be hinged and moved automatically in conjunction with the operation of the cycler.

Stated as a process, the present invention includes thermally cycling multiple samples or samples in sample holders by creating a number of multiple heating/cooling zones each corresponding to one of the modules 14, or to a group of modules which are totally, or in part, coupled to one another operationally, as with the modules described above which are connected to a common cooling manifold. In the preferred form the zones are substantially isolated from one another thermally as well as operationally, except for the aforementioned grouping of the step cooling operation corresponding to the use of the cooling manifold 16.

A cooling step in each zone is preferably carried out by flowing a cooled fluid through the zones. The cooling is of a magnitude sufficient to cause a rapid drop in the temperature of the samples in that zone toward a lower set temperature $T_2$. A heating step also occurs, preferably in each zone, as well as a sensing of the temperature of the samples in those zones. The heating and sensing steps are preferably performed independently of the same steps in other zones (modules). The heating is performed adjacent to samples, and at a point lying generally between the samples and the source of the cooling. The process also includes the step of controlling the heating and cooling in response to the sensed temperature of the sensors 28 and in response to a predetermined program that executes a temperature profile including at least two set temperatures and dwell periods at the set temperatures.

In a preferred form the control of the heating is by multiple simultaneous closed p.i.d. loops. The control step also includes analog-to-digital conversion of the sensed temperature and pulse width modulation of solid state relays which switch electrical resistance heaters on and off to produce a well-controlled heating. The controls also include cooling to a lower set point with an overshoot of the set point in conjunction with a heating step to bring the temperature back up to the set point. The heating and cooling can be substantially equidistant from the samples, but preferably the source of the heating is closer to the samples than the source of the cooling. The zones are preferably provided by at least one, and preferably several, stacked plates of a thermally conductive material.

There has been described an apparatus and method for thermal cycling a high volume of biological chemical samples in a relatively short period of time through a given temperature profile. The cycler produces a throughput that is tens of times greater than single plate thermoelectric units presently available. The response of the present cycler is approximately 2.5 times faster than these current cyclers (90 seconds vs. 210 to 230 seconds for a room temperature to 94° C. cycle) and a plate carrying capacity sixteen times greater than the present cyclers using the preferred embodiment described herein. The apparatus and method for this invention provides a fast response, yet reliably and accurately reaches and maintains multiple set temperatures. The invention also allows a rapid replacement of heating and cooling modules to reduce the down time of the cycler due to equipment malfunction. It also allows greater flexibility than heretofore known, both in terms of adapting readily to a wide variety of labware, or even carrying samples through the cycle without labware, and in terms of allowing the simultaneous running of experiments with different temperature profiles.

While the invention has been described with respect to its preferred embodiments, it will be understood that various modifications alterations will occur to those skilled in the art of the foregoing detailed description and the accompanying drawings. For example, while the invention has been described as a sensing element embedded principally in the heating plate with the element abutting the bottom of the sample plate, it could be embedded, in whole or in part, in the sample plate, or it could even be in the form of a thermocouple or thermal probe mounted in a cover which overlies the samples such that the probe is immersed in the sample itself. It is also within the scope of the invention to utilize less than one temperature sensing element for each module, e.g. one sensor associated with one manifold, as well as using multiple sensing elements per module. Further, while the invention is described with respect to the electrical resistance heating, there are a wide variety of arrangements for producing heat at a given point and it is possible that other forms can be used. However, electrical resistance heating in combination with the structure of the module as described and the electronic controls as described, provides a unique and effective heating which can be quickly and accurately controlled. Further, while the cooling has been described with respect to water as the fluid, it is understood that it could be introduced through a flow of other liquids or even a cooling gas. Also, a wide variety of forms of sealing mechanisms can be used for fluid flows and electrical connections to sensors and heating elements.

Further, while the invention has been described with respect to a heating plate which is distinct from a cooling plate in that it is located physically between the point of cooling and the samples, it is also possible to achieve some of the same effects as described herein while having the cooling at approximately the same vertical level within a module as the heating, but spaced laterally. This could be effected, for example, by machining grooves of substantially equal depth for a cooling passage and to hold an electrical resistance heating element. Therefore when used in this application the words "generally between" when defining a location of the heating plate or a heating region with respect to the cooling region and samples should be taken to include the situation where the heating and cooling are generally on the same vertical level, but to exclude the situation where the principal source of the cooling lies between the samples and the point of the heating. Still further, while the invention has been described with respect to a cycler with multiple modules, the fast response temperature control of the present invention can be used even in a single module cycler. These and other variations and modifications intended to fall within the scope of the appended claims.

What is claimed is:

1. A thermal cycler for the batch processing of biological and chemical samples, comprising, at least one module mounted on the base plate, said module including (i) a sample mounting plate having an upper surface adapted to receive the samples in a good thermal transfer relationship, (ii) a cooling plate having a passage therein to conduct a flow of cooling fluid and (iii) a heating plate located generally between said sample plate and said cooling plate, said cooling plate and said heating plate being constructed to cool and heat said sample mounting plate independently, at least one heating element mounted in said heating plate, at least one temperature sensor associated with said at least one heating plate and located adjacent the associated samples, said sensor producing a signal corresponding to the temperature of said samples, and means for controlling the flow of electrical current and cooling fluid to at least one said module in response to the output signal of said sensor, said controlling means producing a cooling to a pre-selected temperature by cooling below said pre-selected temperature and then heating to said pre-selected temperature.

2. The thermal cycler of claim 1 wherein said at least one module comprises plural modules and wherein said at least one heating element and said at least one sensor comprise plural heating elements and plural sensor each associated with one of said modules, and further comprising, a base that mounts said modules in an array where said modules are substantially thermally isolated from one another, means for distributing said fluid flow and electrical power to each of said modules, and means for replacably sealing said modules to said base and to said distributing means.

3. The thermal cycler of claims 1 or 2 wherein said heating elements are electrical resistance heaters held within said heating plate and extending generally throughout said heating plate to produce a generally uniform temperature profile across said sample mounting plate.

4. The thermal cycler of claims 1 or 2 wherein said temperature sensors are thermocouples.

5. The thermal cycler of claim 2 wherein said distributing means comprises at least one manifold mounted on said base and in fluid communication with said cooling passages in at least two of said modules.

6. A thermal cycler of claim 4 wherein said distributing means further includes valve means associated with each manifold and operated by said controlling means to regulate the flow of cooling fluid to each of said manifolds independently of one another.

7. The thermal cycler of claims 1 or 2 wherein said modules are formed of a material with a high heat conductivity.

8. The thermal cycler of claim 2 wherein said sealing means includes continuous loop, resilient sealing members.

9. The thermal cycler of claims 1 or 2 wherein said heating plate and said cooling plate are formed separately.

10. The thermal cycler of claims 1 or 2 wherein said cooling plate and heating plate are formed integrally and said sample mounting plate is replaceable secured on said heating plate.

11. The thermal cycler of claim 2 wherein said distributing means includes a electrical power conduit mounted on said base in a fluid-tight relationship.

12. The thermal cycler of claims 1 or 2 wherein said controlling means includes a p.i.d. closed loop controller with a channel for each of said at least one heater elements.

13. A thermal cycler of claims 1 or 2 wherein said controller includes solid state relays associated with each of said heating elements to pulse width modulate a current flow to each of them.

* * * * *